United States Patent [19]

Savage et al.

[11] Patent Number: 4,790,383

[45] Date of Patent: Dec. 13, 1988

[54] METHOD AND APPARATUS FOR MULTI-ZONE CASING PERFORATION

[75] Inventors: William A. Savage; Larry N. Kendrick, both of Hobbs, N. Mex.

[73] Assignee: Conoco Inc., Ponca City, Okla.

[21] Appl. No.: 104,455

[22] Filed: Oct. 1, 1987

[51] Int. Cl.[4] ..... E21B 43/117

[52] U.S. Cl. ..... 166/297; 166/55; 175/4.57

[58] Field of Search ..... 166/55, 297; 175/4.53, 175/4.55, 4.57, 300, 301, 4.52, 4.54, 4.56; 102/320; 89/1.15

[56] References Cited

U.S. PATENT DOCUMENTS

| | | | |
|---|---|---|---|
| 2,876,843 | 3/1959 | Huber | 166/55 |
| 2,927,534 | 3/1960 | Le Bus | 102/20 |
| 3,003,558 | 10/1961 | Orr | 166/43 |
| 4,040,482 | 8/1977 | Vann | 166/297 |
| 4,164,886 | 8/1979 | Hallmark | 89/1 C |
| 4,515,217 | 5/1985 | Stout | 166/297 |
| 4,526,233 | 7/1985 | Stout | 166/297 |
| 4,612,992 | 9/1986 | Vann et al. | 166/297 |
| 4,619,333 | 10/1986 | George | 166/55 |
| 4,650,010 | 3/1987 | George et al. | 175/4.52 |

*Primary Examiner*—Jerome W. Massie, IV
*Assistant Examiner*—Terry Lee Melius
*Attorney, Agent, or Firm*—Richard K. Thomson

[57] ABSTRACT

A perforating-gun spacer used to position a plurality of guns to perforate a multizone reservoir is formed of a plurality of telescoping sections which are held in an extended position by tapered pins. A slidable piston maintains the pins in engaged position. When the perforating guns are fired, the resultant pressure pulse in the wellbore fluid moves the piston upwardly out of engagement with the restraining pins which then disengage permitting the telescoping sections to collapse when the expended tool is dropped into the bottom of the wellbore. This avoids partial or complete blockage of the lowermost production zone by the upper portion of the perforating gun string.

9 Claims, 1 Drawing Sheet

METHOD AND APPARATUS FOR MULTI-ZONE CASING PERFORATION

BACKGROUND AND SUMMARY OF THE INVENTION

The present invention is directed to a method and apparatus for simultaneously perforating casing to permit production from two or more production zones. More particularly, the present invention comprises a collapsible spacer for properly positioning each of at least two perforating guns within casing adjacent one of a plurality of production zones, which spacer can substantially reduce its profile when allowed to drop into the bottom of the wellbore below the production zones (known as the "rathole") after the guns have been fired and the tool released.

In drilling oil and gas wells, multizone production is frequently encountered, i.e., more than one reservoir will be located with a single wellbore. Once the full series of casing strings have been set, one of two perforating techniques have been used in the past to permit communication between the production zones and the casing interior.

First, the lowermost zone could be perforated, the well killed by pumping mud downhole to balance the pressure of the production fluids, and then the lower zone packed off to allow a second (and subsequent) perforating gun(s) to be run in to complete one or more additional zones above the first. This method has several disadvantages. It requires multiple trips into the hole which adds to the time and expense of completing the well. In addition, a production zone may be fluid sensitive in which case the mud used to kill the well could contaminate the formation. Further, killing the lower zone not only adds expense, but risks plugging some or all of the newly formed perforations in both the casing and the formation. In a sense, such a procedure has steps which offset or fight one another, a first step to encourage fluids to flow, a subsequent step to curtail (at least temporarily) the flow of those fluids.

A second technique involves the use of a plurality of perforating guns positioned in the desired relationship by an intervening spacer. This technique has the advantage of requiring only a single tool run in and, if the expended tool can be discarded into the rathole, the well need not be exposed to fluid used to kill it, as would be necessary if the tool were retrieved. A disadvantage associated with dropping the expended tool in the rathole is that the borehole has to be drilled a sufficient additional depth below the lowermost production zone to accommodate the full length of the tool or else the upper portion of the tool will interfere with the free flow of production fluids into the casing. As the spacing between the multiple producing zones increases, this can add significant additional time and cost to the drilling of the borehole.

The method and apparatus of the present invention has all the advantages of the second technique without the drawbacks. The spacer used to position the multiple perforating guns, is itself a multicomponent element. A first segment can receive at least one additional segment telescopically, permitting the spacer to collapse to the length of ½ (or less) of the gun spacing. A set of pins maintains the desired spacing between the guns under influence of a movable piston. A longitudinal bore through the piston affords a passageway for the Primacord connecting the plural perforating guns. Upon firing of the perforating guns, the piston is caused to slide out of engagement with the pins which then disengage the two segments permitting their collapse when the tool is dropped into the rathole.

Various other characteristics, features, and advantages of the present invention will become apparent after a reading of the following detailed description.

DETAILED DESCRIPTION OF THE PREFERRED EMBODIMENT(S)

Figure 1:
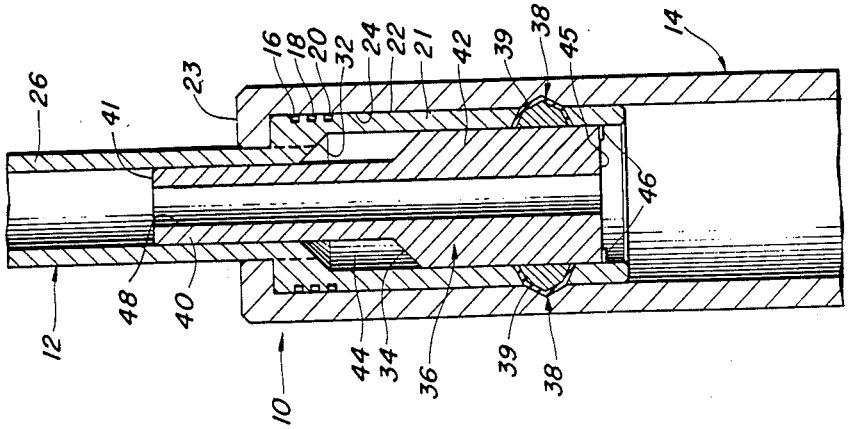
FIG. 1 is a detailed cross sectional side view of the telescoping perforating gun spacer of the present invention.

The telescoping gun-spacer of the present invention is shown in FIG. 1 generally at 10. As there shown, telescopying gun-spacer 10 comprises a first section 12 and at least one additional section 14. While it is preferred that section 12 telescope within section 14 (to reduce the possibility of section 23 hanging up on the sidewall of casing 13 within borehole 11 [FIG. 2*a*]), it will be apparent section 14 could telescope within section 12. Further, although only the simplest two-component telescoping system has been shown, obviously three or more sections could be employed with the third lowermost section receiving section 14 or, alternatively, also collapsing within it, as does section 12.

O-ring seals 16, 18 and 20 are positioned in grooves in the outer surface of enlarged lower portion 21 of first section 12 and compressed against polished bore 24 of section 14 to inhibit the influx of wellbore fluids into gun-spacer 10. While three O-ring seals have been shown, a minimum of two such seals are required and more could be added. Alternatively, a different type of seal such as a chevron seal could be used for this purpose. It is important that fluids not prematurely enter gun-spacer 10, for reasons discussed herebelow.

Enlarged portion 21 may be formed integrally on section 12 as by turning on a lathe or, more preferably, for ease of manufacture and assembly, portion 21 may be formed by a separate member which is threaded onto section 12 at the point shown in dotted lines in FIG. 1. However it is formed, the upper inner surface 32 of portion 21 is frustoconical or beveled. A mating beveled surface 34 is formed on piston member 36. Piston 36 serves to hold, for example, four locking pins 38 (two shown) in engagement with gun-spacer sections 12 and 14 which, in turn, maintain sections 12 and 14 at their extended position. The laterally outward surfaces of pins 38 are preferably coated with a resilient elastomeric material as at 39 which will serve to help eject the pins 38 at the appropriate time.

Piston member 36 has a first end 40 that is snugly, but slidingly, received within the upper portion 26 of section 12 and a second end 42 that is snugly, but slidingly, received within enlarged portion 21 of section 12. The reason for the fit being snug is in order to isolate the space 44 so that it may remain at a pressure $P_1$, lower than a pressure $P_2$ created by the influx of wellbore fluids or the pressure pulse from the explosive charge. $P_1$ may, for example, remain at or near the atmospheric pressure at the surface of the borehole 11. Appropriate seals (not shown) may be provided to maintain a sufficient pressure differential between space 44 and the inside of gun-spacer 10. The external diameter of second end 42 is preferably at least twice that of first end 40 so that the surface area of the bottom 45 of piston 36 is at least four times that of the top 41. This will insure a sufficient net upward force due to the difference in pressure between $P_1$ acting on surface 34 and $P_2$ acting on surface 45 to insure that the piston will move upwardly. Set screws 46 may be permitted to extend laterally into the interior of enlarged portion 21 to provide a seat for piston member 36 and prevent it from falling out. A longitudinal bore 48 extends through the piston providing a passage for an electrical connector or ultra-high speed fuse 50 (preferably Primacord) to extend between first and second perforating guns 52 and 54 (FIG. 2*a*). The interior of gun-spacer 10 needs to be sealed against fluid influx to prevent moisture from interfering with the operation of connector 50.

In use, a production tubing string 60 will be made up with a first perforating gun string 62 releasably attached to the bottom of tubing string 60 by release mechanism 64. One such suitable mechanism is available from Vann Systems and is described as a "mechanical release firer". Such a release mechanism can be actuated to release the gun string 62 by one of three methods: (a) by dropping a release bar from the surface to set off the perforating guns and simultaneously triggering a mechanical release mechanism, or (b) if the guns and release tool are equipped with a pressure actuatable firing head, by pressurizing the casing 13 to a pressure which exceeds a predetermined gun firing pressure in which case the resulting pressure pulse will activate the release or, (c) the guns may be fired by pressurizing the casing as in 'b' above and the release mechanism 64 actuated by a wire-line operation, in a conventional manner. Logs across the drilled interval 11 will be used to identify the depths of the production zones. The first perforating gun 52 will be positioned adjacent the uppermost production zone 15 and a gun-spacer 10 of appropriate length will be used to space a second (and, possibly, subsequent) gun(s) 54 adjacent a second (and third, etc.) production zone 17. First and second perforating guns 52 and 54 will be interconnected by Primacord 50. When guns 52 and 54 have been properly located, a conventional packer 66 will be actuated to fix their position prior to firing.

A drop bar (not shown) or casing pressurizing system is used, as discussed above, to fire the perforating guns 52 and 54. The pressure surge or pulse $P_2$ resulting from the detonation will (a) cause piston 36 to move upwardly where the beveled surface 34 on piston 36 contacts beveled surface 32 on enlarged portion 21 and, (b) may trigger release mechanism 64 (or release mechanism 64 may be actuated mechanically, as noted above). In its upper position, piston 36 no longer blocks movement of locking pins 38. Accordingly, resilient elastomeric material 39 pushes pins 38 inwardly into the bore of the gun-spacer 10. Should the locking pins 38 fail to be ejected by the elastomer 39, the contoured points on pins 38 will be ejected by the beveled surfaces on sections 12 and 14 when the perforating gun string 62 hits the bottom of rathole 19 collapsing section 12 into section 14. Even if the pressure $P_2$ equalizes across piston 36 permitting it to drop before pins 38 have been fully ejected, the elastomer 39 will have pushed pins 38 into the path of piston 36 so that piston 36 will complete the ejection procedure.

Figure 3:
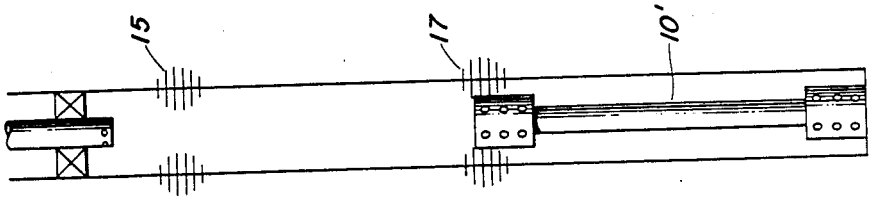
FIG. 3 (PRIOR ART)
FIG. 3 is a schematic side view depicting a prior art gun spacer for purposes of comparison.
Figure 2B:
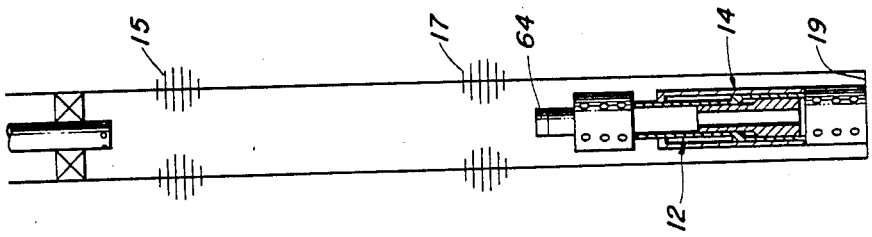
FIG. 2*b* is a schematic side view of the telescoping spacer of the present invention as it would be configured after firing the guns and the expanded tool had been dropped into the rathole.
Figure 2A:
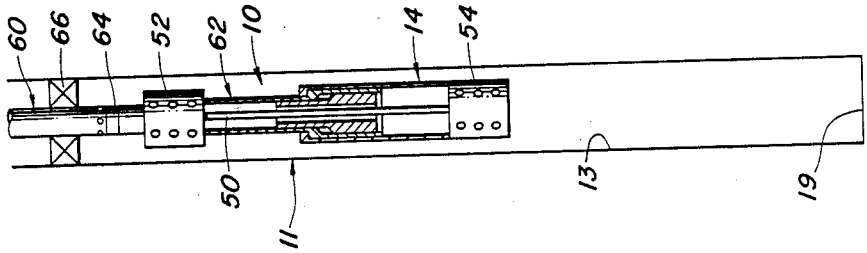
FIG. 2*a* is a schematic side view depicting the telescoping spacer of the present invention positioned prior to firing of the perforating guns.

The collapsible gun-spacer 10 of the present invention is schematically depicted in FIG. 2*b* for purposes of comparison to the prior art multizone perforating gun as shown in FIG. 3. As can be seen, the collapsible spacer 10 enables gun train 62 to be disposed of by dropping into rathole 19 without any interference with fluid influx into the wellbore from the lower production zone 17. This is in stark contrast to the prior art gun spacer 10' whose upper portion effectively blocks off influx from lower production zone 17.

Various changes, alternatives and modifications to the above disclosed preferred embodiments will be apparent to the person of ordinary skill in the art following a reading of the foregoing description. Accordingly, it is intended that all such changes, alternatives and modifications as fall within the scope of the appended claims be considered part of the present invention.

We claim:

1. Apparatus for perforating spaced, multiple zones of a cased wellbore, said apparatus comprising:

a first perforating gun;

means for detachably attaching said first perforating gun to a lower end of a production gun;

a second perforating gun;

means for securing said second perforating gun at a fixed interval relative to said first perforating gun, said fixed interval being equal to the distance between said spaced multiple zones, said means for securing including a first telescoping spacer section, at least one additional telescoping spacer section, said first and said at least one additional telescoping spacer section being formed so that one may be received substantially within the other, means for releasably holding said one telescoping spacer section at an extended position with respect to the other, means for sealing said one spacer section with respect to the other to prevent fluid influx, means for mechanically releasing said releasable holding means to enable said telescoping spacer sections to collapse under their own weight sliding relative to each other upon detachment of said attaching means dropping said perforating apparatus into a rathole after said perforating guns have been fired, said means for mechanically releasing being formed as part of said perforating apparatus.

2. The perforating apparatus of claim 1 further comprising means for packing off said perforating guns prior to firing, said pack off means being connected to the lower end of said production tubing, above and proximate to said detachable attaching means.

3. The perforating apparatus of claim 1 wherein said releasable holding means include locking pins engaging both said first telescoping spacer section and said at least one additional telescoping spacer section.

4. The perforating apparatus of claim 3 further comprising a hollow piston cylinder which, in a first position, secures said locking pins in place prior to firing of said perforating guns.

5. The perforating apparatus of claim 4 wherein said hollow piston cylinder has an enlarged head surface area operable by a fluid pressure surge following the detonation of said perforating guns to slide said hollow piston cylinder to a second position where it does not engage said locking pins.

6. The perforating apparatus of claim 3 further comprising resilient means biasing said locking pins out of engagement with said first telescoping spacer.

7. The method of simultaneously perforating spaced multiple zones of a cased wellbore, said method comprising:

interconnecting a plurality of perforating guns into a train using at least two telescoping spacer sections interconnected by at least one releasable holding means; attaching said interconnected train to one end of a string of production tubing; suspending one of the perforating guns adjacent each zone to be perforated;

firing said perforating guns thereby creating a pressure pulse which actuates said releasable holding means enabling said two telescoping spacer sections to telescope one into the other;

releasing said interconnected train of perforating guns from said one end of said string of production tubing thereby causing said interconnected plurality of perforating guns to drop into a rathole at the bottom of said wellbore collapsing said at least two telescoping spacer sections.

8. The method of claim 7 wherein said step of firing said perforating guns includes compressing borehole fluids to create said pressure pulse.

9. The method of claim 7 wherein said step of firing said perforating guns includes opening a passageway into said at least two telescoping spacer sections to permit an influx of wellbore fluids to create said pressure pulse.

* * * * *